US007703638B2

(12) United States Patent
Magnani

(10) Patent No.: US 7,703,638 B2
(45) Date of Patent: Apr. 27, 2010

(54) FASTENER DISPENSER

(76) Inventor: Mario Enrico Magnani, 74 Pine Hill Rd., Springfield, MA (US) 01118

( * ) Notice: Subject to any disclaimer, the term of this patent is extended or adjusted under 35 U.S.C. 154(b) by 686 days.

(21) Appl. No.: 11/539,911

(22) Filed: Oct. 10, 2006

(65) Prior Publication Data

US 2007/0138310 A1 Jun. 21, 2007

Related U.S. Application Data

(60) Provisional application No. 60/748,091, filed on Dec. 6, 2005.

(51) Int. Cl.
*A47F 1/04* (2006.01)

(52) U.S. Cl. ..... 221/310; 221/165; 221/185

(58) Field of Classification Search ..... 221/165, 221/312 A, 185, 310
See application file for complete search history.

(56) References Cited

U.S. PATENT DOCUMENTS

| | | | | | |
|---|---|---|---|---|---|
| 532,737 | A | * | 1/1895 | Miles | 221/68 |
| 688,731 | A | * | 12/1901 | Hinds | 221/68 |
| 3,014,617 | A | | 12/1961 | Kireta | |
| 3,105,611 | A | | 10/1963 | Conti | |
| 3,272,411 | A | | 9/1966 | Hanson | |
| 3,582,600 | A | * | 6/1971 | Kauffman | 219/69.18 |
| 3,800,981 | A | | 4/1974 | Zeller | |
| 3,883,041 | A | | 5/1975 | Olson | |
| 4,685,600 | A | | 8/1987 | Reuschel | |
| 5,547,115 | A | | 8/1996 | Ambrosius et al. | |
| 5,593,073 | A | | 1/1997 | Finnegan | |
| 5,758,807 | A | | 6/1998 | Wright | |
| 6,003,726 | A | * | 12/1999 | Hawkes | 221/310 |
| 6,571,997 | B2 | | 6/2003 | Dedrick | |
| 6,817,135 | B1 | | 11/2004 | Jackson | |
| 2003/0034367 | A1 | | 2/2003 | Goodhue | |
| 2003/0052143 | A1 | | 3/2003 | Devine | |
| 2003/0071095 | A1 | | 4/2003 | Dedrick | |
| 2006/0096875 | A1 | | 5/2006 | Smith | |

* cited by examiner

*Primary Examiner*—Gene Crawford
*Assistant Examiner*—Timothy R Waggoner
(74) *Attorney, Agent, or Firm*—McCormick, Paulding & Huber LLP

(57) ABSTRACT

A fastener dispenser including a housing having a plurality of rails formed thereon. The rails have terminal ends that are open to facilitate the passage of fasteners into or out of the housing. Fasteners are removably secured between adjacent rails and maintained in a predefined orientation by the adjacent rails. The fastener dispenser also includes fastener release means on the terminal ends of the rails for maintaining fasteners between adjacent rails. The fastener release means also allow a user to selectively dispense a desired number of fasteners from between the rails.

7 Claims, 6 Drawing Sheets

FASTENER DISPENSER

CROSS REFERENCE TO RELATED APPLICATIONS

This application claims the benefit of U.S. Provisional Patent Application Ser. No. 60/748,091 filed on Dec. 6, 2005, entitled "FASTENER DISPENSER" which is herein incorporated by reference in its entirety.

FIELD OF THE INVENTION

The present invention relates generally to a dispenser for fasteners and more specifically to a body-worn dispenser for screws and the like.

BACKGROUND OF THE INVENTION

In the construction and maintenance trades, craftsmen need quick and easy access to the self-tapping screws, drywall screws, deck fasteners and other fasteners required to complete a job. For example, a worker building an average-sized deck will have handled more than 500 fasteners by the time the project is finished. Fasteners are most commonly held in pouches hung from a work belt or stored in a plastic/cardboard container. Several difficulties arise, however, when using either a tool pouch or a container to store and retrieve fasteners.

When the worker reaches into a tool pouch to retrieve a fastener(s), his fingers may be pricked by the points of the randomly oriented screws, particularly in the case of self-tapping screws, metal screws or drywall screws. At the very least, the repeated process of retrieving these fasteners will irritate the worker's fingers. As the worker retrieves a handful of jumbled fasteners, many users will take the time to orient the heads in the same direction before they begin applying them to a work surface. This takes valuable time and slows down the application process. Finally, the jumbled fasteners often fall out of the users grasp, many with retrieve them while others simply move on.

Further, many workers spend a significant amount of time bent over or on their knees while working, which often leads to the fasteners falling out of the pouch. To counter this, workers often position the pouches behind themselves, which may prevent accidental spills, but forces the worker into an awkward position every time he reaches into the pouch. Fasteners can also fall out of a tool pouch when a user removes his tool belt and lays it down on a surface, which necessitates the need to pick them up.

Plastic buckets or cardboard boxes also present difficulties. Since buckets and boxes are stationary and not worn on the body, they require the worker to frequently relocate them so they stay within easy reach. Workers also suffer from the same painful process of having to reach into the randomly oriented fasteners in the bucket or box and pull out the required number of fasteners.

There is a need, therefore, for a dispenser that facilitates the quick retrieval of fasteners while eliminating the above-described difficulties associated with existing systems.

SUMMARY OF THE INVENTION

An object of the present invention is to provide a dispenser that facilitates the quick removal of fasteners regardless of the position of a worker using the dispenser.

An additional object of the present invention is to provide a dispenser that comes pre-loaded with fasteners from the manufacturer.

Another object of the present invention is to provide a dispenser in which the fasteners are all oriented in the same direction reducing the possibility of a worker injuring or irritating his fingers upon retrieval of a fastener.

Yet another object of the present invention is to provide a dispenser that allows a worker to easily and quickly select a desired number of fasteners and to determine the remaining number of fasteners in the dispenser.

An object of the present invention is to provide a fastener dispenser that can be quickly replaced when empty or when a project is completed and enhances worker productivity through ease of use.

These and other objects of the present invention, and their preferred embodiments, shall become clear by consideration of the specification, claims and drawings taken as a whole.

BRIEF DESCRIPTION OF THE DRAWINGS

Referring now to the drawings wherein like elements are numbered alike in the several Figures.

DETAILED DESCRIPTION OF A PREFERRED EMBODIMENT

Figure 1:
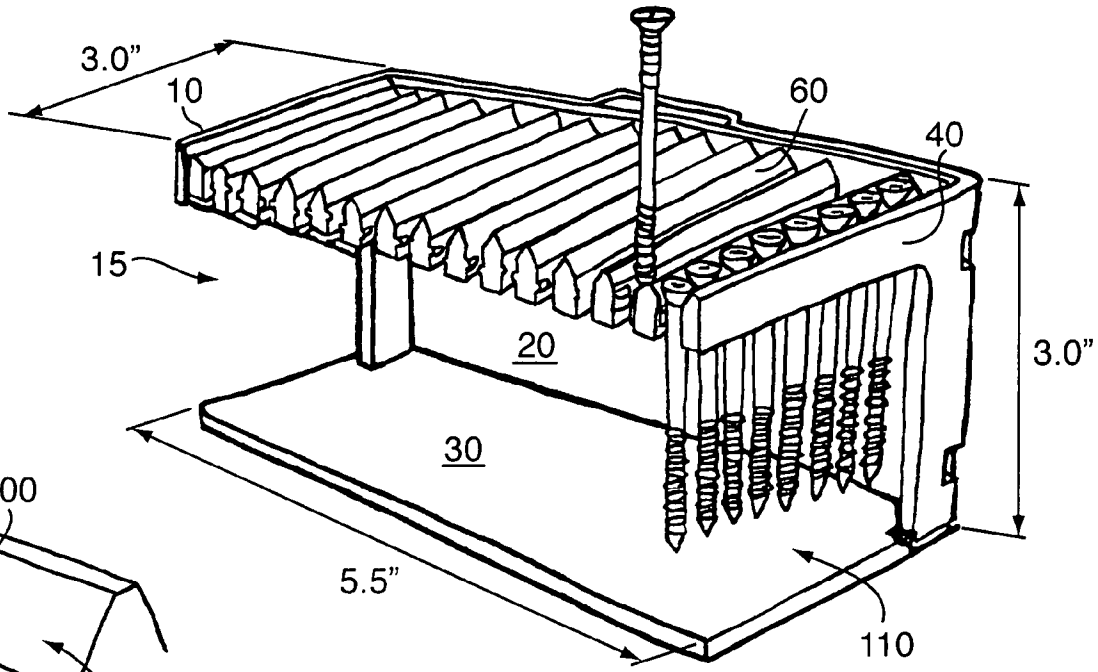
FIG. 1 is a perspective view of an embodiment of the inventive fastener dispenser depicting the housing.

FIGS. 1-4 depict a preferred embodiment of the fastener dispenser of the present invention. Referring to FIG. 1, the fastener dispenser includes a housing 10. The housing 10 features a back wall 20, an optional bottom wall 30 and side walls 40. The interior surfaces of the back wall 20, bottom wall 30 and side walls 40 define a fastener cavity 15 in which fasteners, such as screws and the like, are removably retained.

Fasteners are removably retained through a plurality of outwardly extending rails 60 that extend from the housing 10. Specifically, the rails 60 are formed on, or are connected to, the interior surface of the back wall 20 of the housing 10 and extend in a direction substantially perpendicular to the back wall 20. Preferably, the rails 60 extend from an upper portion of the interior surface of the back wall 20. The rails 60 are linear and are spaced apart such that a fastener may be placed in the channel 70 formed between two adjacent rails 60 and be retained in the channel 70. The rails 60 are also spaced apart to allow fasteners to slide back and forth in the channel 70 so that they may be easily removed from the fastener cavity.

The rails 60 also have a terminal open end 80 that is not connected to the housing 10. As will be appreciated, fasteners are placed in a channel 70 between adjacent rails 60 by inserting them through the open end 80 and pushing them toward the back wall 20 of the housing 10. Likewise, fasteners are removed from adjacent rails 60 by sliding them away from the back wall 20 through the open rail ends 80. As will be appreciated, fasteners may also be dropped in between adjacent rails 60 from above to load the dispenser.

Further, the rails 60 include a fastener release means at their rail ends 80. Preferably, the fastener release means is a pair of protrusions or resilient members 70 located on opposite sides of adjacent rails ends 80. The resilient members 90 hold the fasteners in the channels 70 between adjacent rails 60 in the fastener cavity of the housing until they are selectively dispensed by a user.

Figure 2:
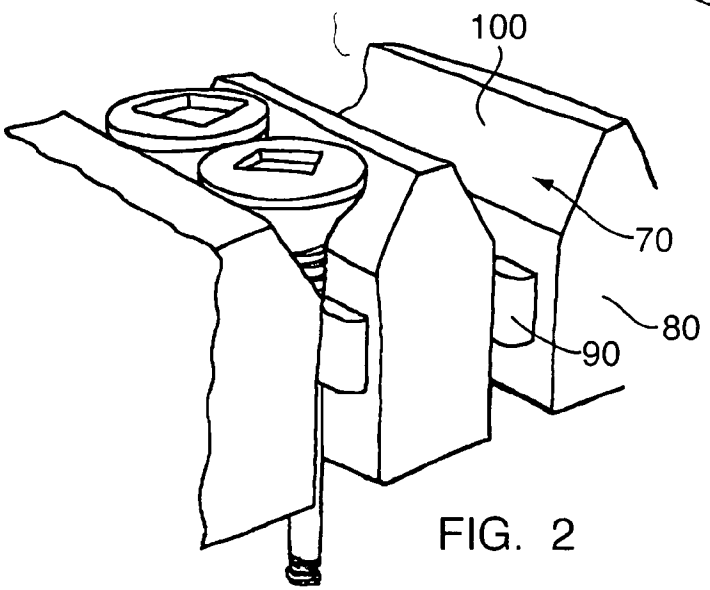
FIG. 2 is an enlarged perspective view of the fastener dispenser of FIG. 1 illustrating the rails.

The resilient members 90 are an important aspect of the present invention as they as they are sized and disposed to secure fasteners in the channels 70 under normal conditions allowing a user to freely move about a jobsite without having fasteners fall out of the fastener cavity. Importantly, the resilient members 90 also deform or compress to allow a fastener to be extracted from between adjacent rails 80 by a user when required. As shown in FIG. 2, the resilient members 90 are preferably semi-circular or curved facilitating the ingress and egress of fasteners between adjacent rails 60.

Additionally, the rails 60 have a cut-away or chamfered upper portion in which each rail 60 has two chamfered surfaces 100 on opposing sides of each rail 60 that extend along substantially the entire length of each rail 60. The chamfered surfaces 100 between adjacent rails 60 create a channel 70 that is shaped to accommodate the head of a fastener such as a deck screw. The chamfered surfaces 100 are another important aspect of the present invention in that they help maintain the orientation of fasteners in the cavity and allow fasteners to be slidably moved along the rails 60 and out of the cavity. As will be appreciated, however, the rails 60 may optionally have an upper portion without chamfered edges to accommodate other types of fasteners such as flat head nails.

Referring back to FIG. 1, the side walls 40 each have a cut away portion or side opening 110 which allows fasteners to be removed from the cavity. The side openings 110 in the side walls 40 are yet another important aspect of the present invention in that they allow a user to reach into the cavity, grasp a fastener(s) and slidably remove the fastener for use. As will be appreciated, fasteners may also be removed from the front of the housing 10 should the side openings 110 be inaccessible. Moreover, it is possible for the housing 10 to not have side walls 110 and just have substantially open sides allowing a user to access and remove stored fasteners. It is also possible that the housing 10 be manufactured in two pieces with the back 20 and bottom walls 30 being selectively removable from the side walls 40 and rails 60 potentially saving money during the manufacturing process.

Figure 3:
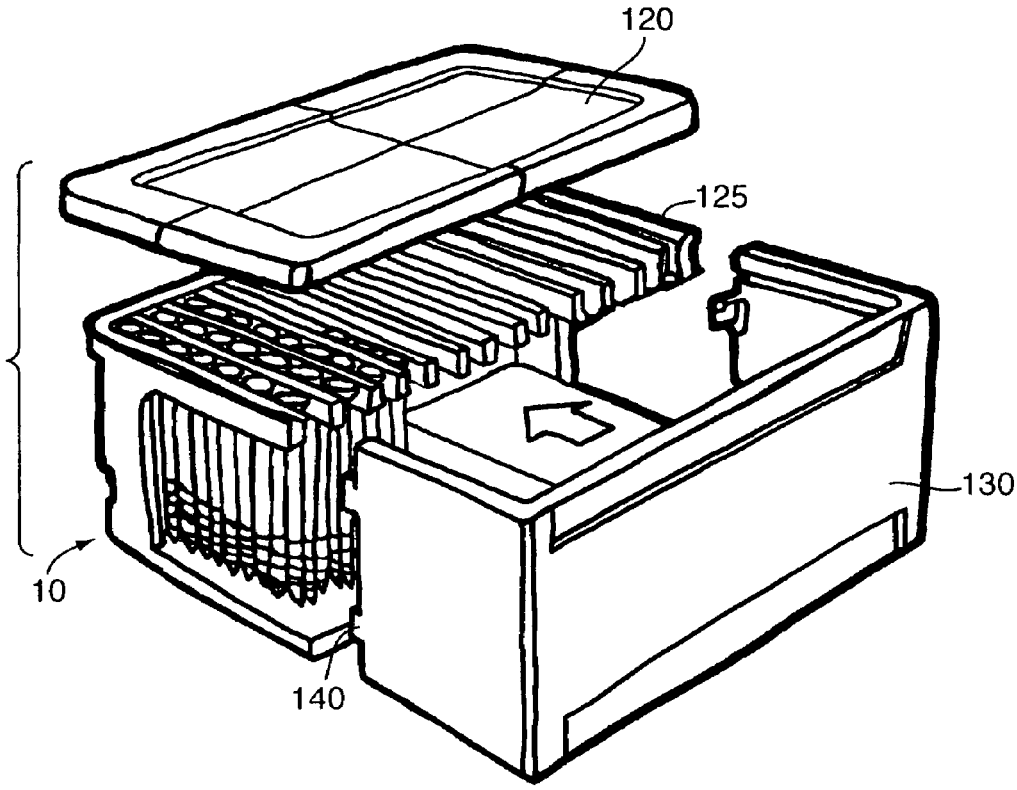
FIG. 3 is an exploded perspective view of the fastener dispenser of FIG. 1 with the cover and front panel.

Turning now to FIG. 3, the housing 10 is preferably enclosed by a removable cover 120 and may also include a removable front panel 130. The cover 120 and panel 130 are used to further secure the fasteners in the cavity. This is an important aspect of the present invention in that the inventive dispenser is preferably sold to users preloaded with fasteners. The cover 120 and panel 130 may prevent fasteners from being dislodged during shipping to vendors.

Figure 4:
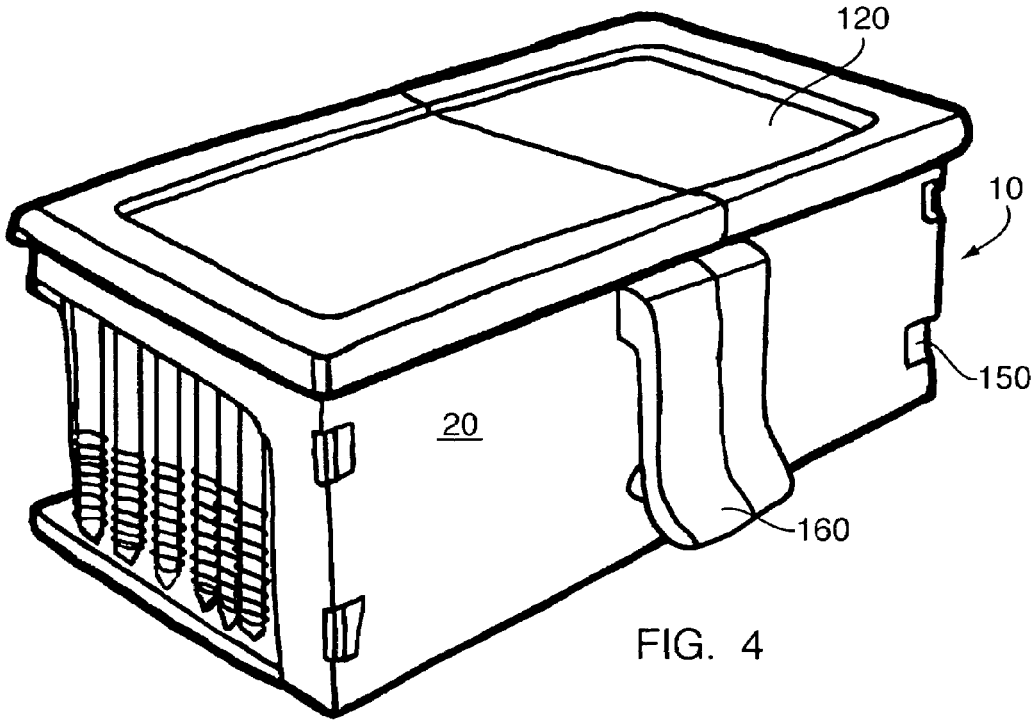
FIG. 4 is a rear perspective view of the fastener dispenser of FIG. 1 depicting the belt clip.

Additionally, as illustrated in FIG. 4, the cover 120 remains on the housing 10 when the dispenser is configured for use. The cover 120 remains affixed to ensure that fasteners are secured in the dispenser when a user/wearer leans forward or otherwise moves about. As will be appreciated, the edge the cover 120 snaps over a lip 125 that is above the rails 60 such that the cover 120 does not overlap or obstruct the rails and allows removal of fasteners while the cover 120 is in place. In addition, the panel 130 may be placed on the housing 10 after a portion of the fasteners have been used and the user wants to store the dispenser for subsequent use. The front panel 130 may be slid onto the housing via rails and then snapped into place through tabs 140 on the panel 130 that fit into recesses 150 in the exterior surface of the back wall (FIG. 4).

Additionally, as shown in FIG. 4, the exterior surface of the back wall 20 includes a belt clip 160. The belt clip 160 allows the dispenser to be removably attached to a worker's tool belt. As will be appreciated, however, the dispenser may also be set on a horizontal surface on a jobsite rather than mounted to a user's workbelt. The dispenser may also be helpful for storing aligned fasteners which are to be later placed in a conventional workbelt pouch.

The above-referenced embodiment works well with fasteners that are 1 inch or greater in length. Moreover, this embodiment preferably holds 100-200 screws or nails. As will be appreciated, the dispenser may be larger or smaller and may accommodate varying numbers of fasteners. Additionally, this embodiment and the others are sized to comfortably fit on a worker's belt while allowing significant freedom of movement. Keeping this in mind, the dispenser is preferably approximately five and one half inches wide and three inches deep (FIG. 1).

Figure 6:
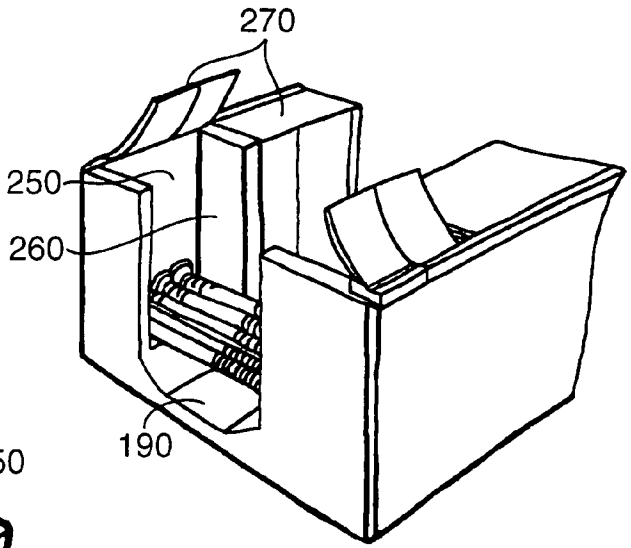
FIG. 6 is an additional perspective view of the fastener dispenser of FIG. 5 depicting the compartments, fasteners and flaps.
Figure 5:
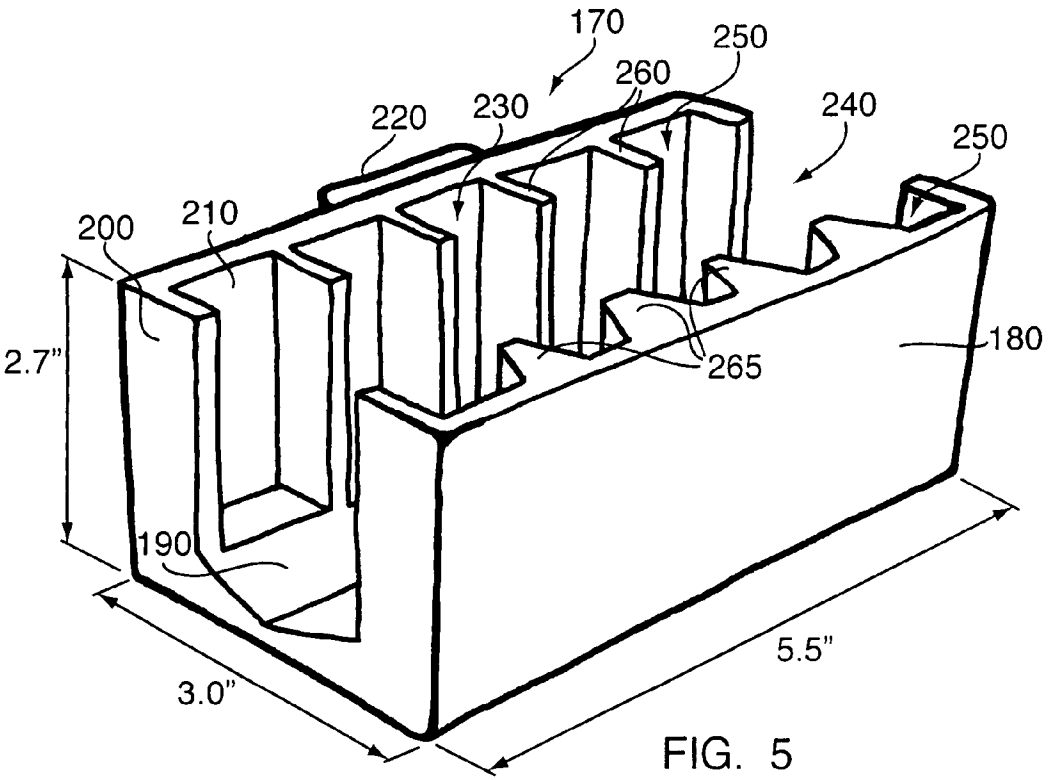
FIG. 5 is a perspective view of an alternative embodiment of a fastener dispenser of the present invention.
Figure 7:
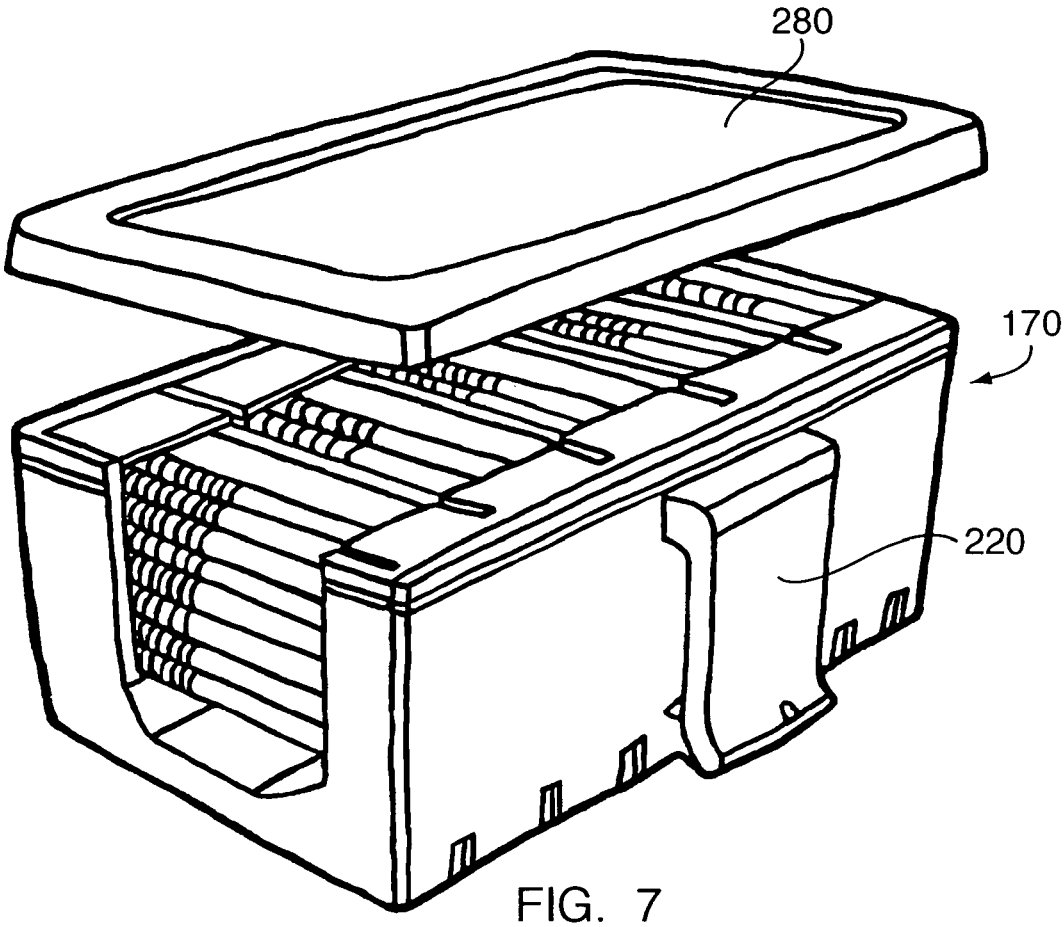
FIG. 7 is a rear perspective view of the fastener dispenser of FIG. 5 with storage cover.

FIGS. 5-7 illustrate an alternative embodiment of the present invention ideal for fasteners greater than two inches in length. Referring to FIG. 5, the housing 170 has a front wall 180 in addition to a bottom wall 190, side walls 200 and a back wall 210. The exterior surface of the back wall 210 includes a belt clip 220. The interior surfaces of the bottom wall 190 and side walls 200, back wall 210 and front wall 180 define a fastener cavity 230 in which fasteners, such as screws and the like, are removably retained. The side walls 200 feature side openings 240 to allow access to fasteners stored in the cavity.

The fastener cavity 230 is divided into a plurality of compartments 250 by a series of ribs on the interior surfaces of both the front 180 and back 210 walls of the cavity. The ribs on the back wall 210, referred to as the back ribs 260, extend linearly along substantially the entire length of the back 210 wall of the housing 170 in a direction that is perpendicular to the bottom wall 190 of the housing 170. Importantly, the back ribs 260 do not extend across the housing 170, i.e., they do not extend from the back wall 210 to the front wall, and do not meet. That is, the front and back ribs are independent and are spaced apart from one another. This spacing is an important aspect of the present invention in that once all fasteners have been used from the compartment adjacent a side opening 240, fasteners located in the interior compartments can be accessed through the space between the ribs of the front wall 180 and those of the back wall 210.

Further, the ribs on the front wall 180, referred to herein as the front ribs 265, are substantially trapezoidal or angled in shape to create a compartment 250 that is narrower at the front wall 180 than at the back wall 210. As will be appreciated, this narrowing or tapering may also be accomplished through front ribs that are thicker than the back ribs 260 regardless of shape. Moreover, the front ribs 265 may be substantially the same thickness as the back ribs 260 but may be spaced closer together to create a tapered compartment 250.

The shape of the compartments 250 are another important aspect of the present invention in that they are shaped so that when fasteners are loaded into the compartments 250 they stack at the same rate. This is accomplished by loading the wider heads of the fasteners into the wider back wall 210 end of each compartment 250 and the narrower tips into the front wall 180 end of each compartment. This way both fastener ends stack at the same rate, despite their disparate sizes, due to the reduced amount of space at the front wall 180 end. Therefore, the tapering shape of the compartments 250 keeps the fasteners horizontally aligned which is extremely important during shipping and use. Moreover, alignment is also maintained by sizing the compartments so that they are not as wide or as tall as the fasteners are long. Therefore, the fasteners cannot rotate significantly within the compartments and are thereby stabilized.

Referring now to FIG. 6, each compartment has two flaps 270 one attached to the upper portion of the front wall 180 and back wall 210 of the housing 170. Each flap 270 extends outward toward the interior of the cavity in a direction substantially parallel to the bottom wall 190. The flaps 270 extend into the cavity approximately the same distance as the ribs 260, 265 extend into the cavity. As will be appreciated, the flaps 270 may be removably attached to the housing via a press or snap fit or may be permanently secured to the housing. The flaps may also be molded as a living hinge and snapped into place.

The flaps 270 are an important aspect of the present invention in that they cover the compartments 250 to secure fasteners under normal conditions allowing a user to move about without having fasteners dislodge and fall out of the fastener cavity. The flaps 230 are also pliable and bend upward to allow a user to extract a fastener when required.

As shown in FIG. 7, dispenser includes a belt clip and optionally a cover 280. The cover 280 is important as it provides additional protection against loss of fasteners from the compartments particularly if the dispenser is sold and shipped preloaded.

Figure 8:
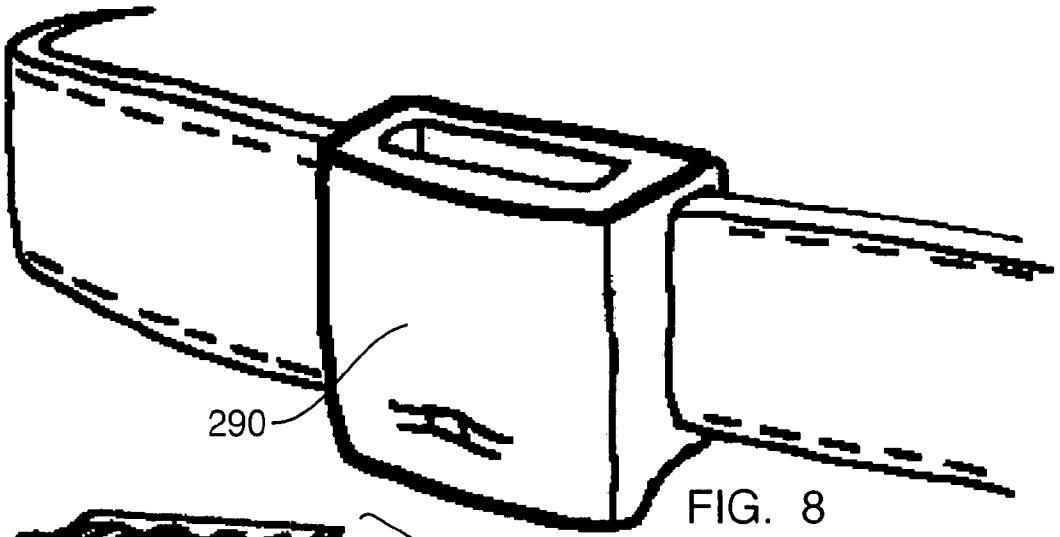
FIG. 8 is a perspective view of a receptacle on a work belt that accepts a belt clip of an embodiment of the inventive fastener dispenser.
Figure 9:
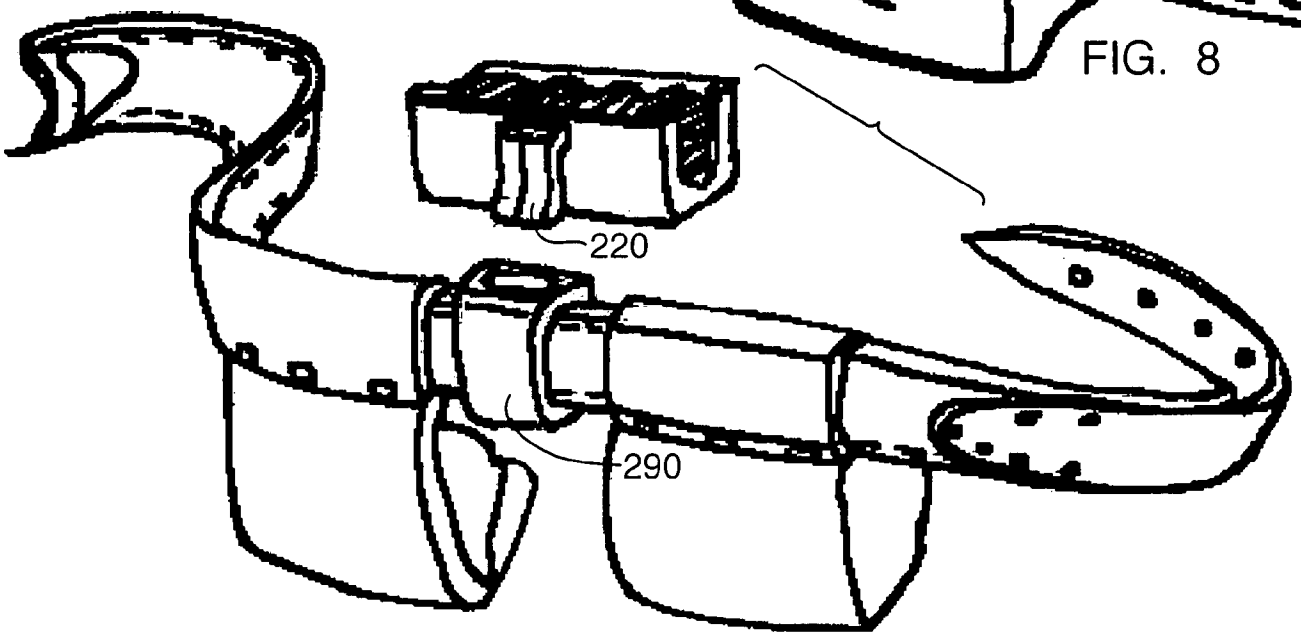
FIG. 9 is a perspective view of the receptacle of FIG. 8 with a belt clip and fastener dispenser.

FIGS. 8 and 9 show an alternate embodiment of the belt clip 220 described above. The belt clip 220 illustrated in these figures is a two-piece design with a receptacle 290 removably fixed to a work belt. The clip 220 on the back of the dispenser removably fits and locks into the receptacle 290. The clip 220 preferably snap fits within the receptacle and features a quick release mechanism to aid removal. This belt clip configuration may provide additional strength to support a fully loaded dispenser on a user's work belt.

Figure 10:
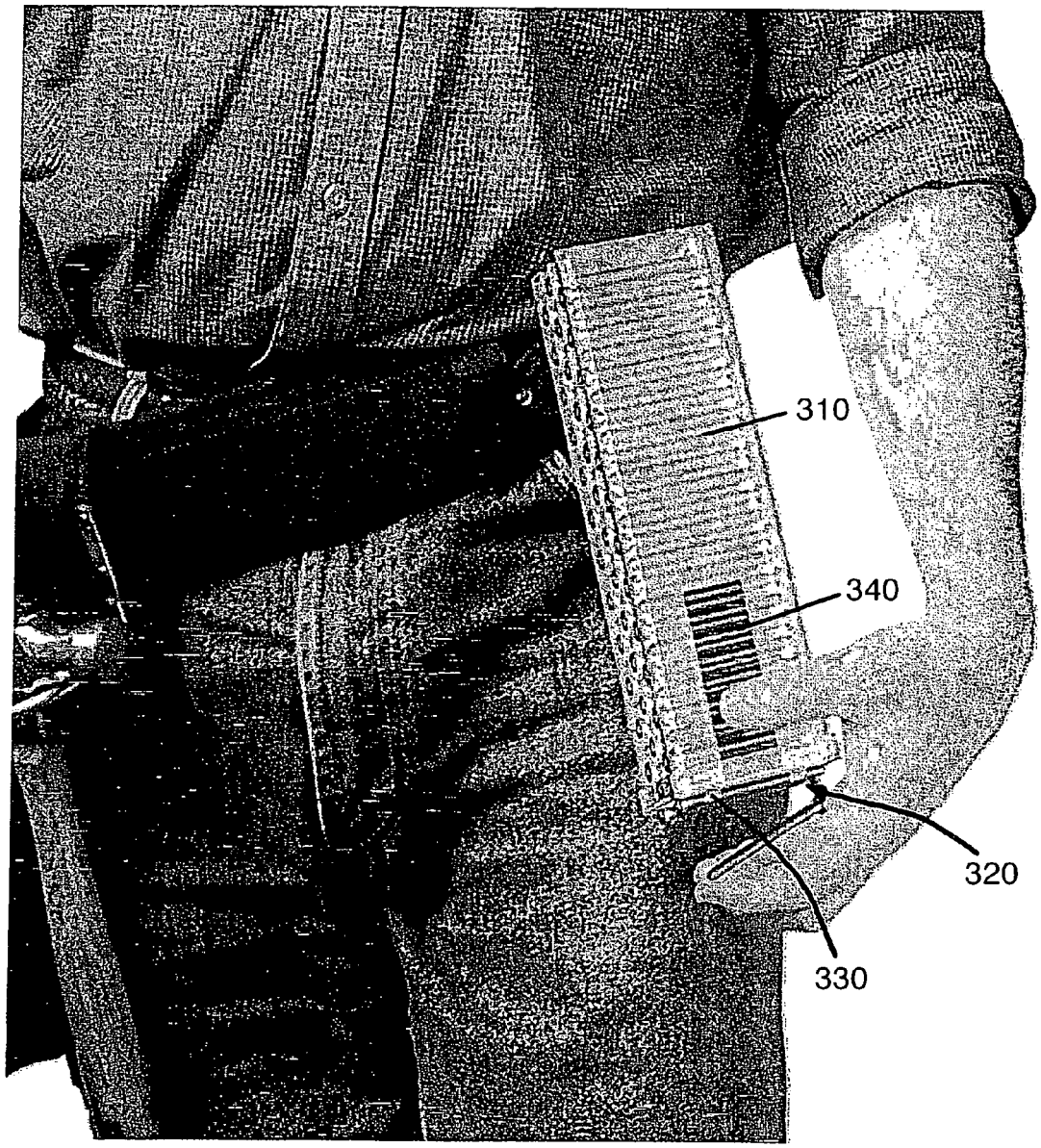
FIG. 10 is a view of another embodiment of the inventive fastener dispenser on a user's work belt.

FIG. 10 depicts yet another embodiment of the present invention secured to the work belt of a user. This embodiment has a housing 310 with several chambers or compartments that are loaded with fasteners. The fasteners are drawn toward an open lower or bottom end of the housing 320. Fasteners are urged toward the opening by gravity and are removed from the compartments by pulling them past tabs 330 on the open end 320 of the dispenser. The front wall of the dispenser preferably has an opening 340 from which fasteners may be grasped or thumbed out. As shown in FIG. 10, the dispenser may have several compartments that are stacked on top of each other to hold a substantial number of fasteners. Preferably, the tabs 330 are secured to a cap that fits over the open bottom end, they may also, however, be attached directly to the open end 320.

As will be appreciated, the inventive fastener dispenser can be made from a wide variety of materials. At this time, the preferred material for making the fastener dispenser is plastic that is thick enough to provide structural rigidity to the housing yet pliable to allow the passage of fasteners past the flaps and the resilient members. Presently the preferred method of making the fastener dispenser is molding, or a vacuum forming process where appropriate.

While preferred embodiments of the invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A fastener dispenser, comprising:

a housing having a plurality of rails formed thereon, said rails having terminal ends that are open to facilitate the passage of fasteners into or out of said housing, wherein said fasteners are removably secured between adjacent rails and maintained in a predefined orientation by said adjacent rails;

a fastener release means on the terminal ends of said rails for maintaining fasteners between adjacent rails and allowing a user to selectively dispense a desired number of fasteners; and wherein said housing further comprises a back wall, a bottom wall, a top portion, open sides, and an open front, wherein said bottom wall and top portion are substantially parallel to each other and orthogonal to said back wall, and wherein said rails are formed on the top portion and said back wall includes a belt clip to removably secure the dispenser to a user.

2. The fastener dispenser of claim 1 further comprising a cover that is attached to said top portion of the housing when the dispenser is in use and a front panel that may be selectively attached to said housing to cover said open sides and open front.

3. A fastener dispenser that may be preloaded with fasteners, comprising:

a housing including a back wall, a bottom wall, a top portion, open sides, and an open front, wherein said bottom wall and top portion are substantially parallel to each other and orthogonal to said back wall; a plurality of rails formed on said top portion, said rails having terminal ends that are open to facilitate the passage of fasteners into or out of said housing, wherein said fasteners are removably secured between adjacent rails and maintained in a predefined orientation by said adjacent rails; and a fastener release means on the terminal ends of said rails for maintaining fasteners between adjacent rails and allowing a user to selectively dispense a desired number of fasteners from between said rails.

4. The fastener dispenser of claim 3 wherein said rails have chamfered upper surfaces shaped to accommodate the head of a fastener and facilitate sliding said fastener along adjacent rails into or out of said housing.

5. The fastener dispenser of claim 3 wherein said fastener release means is at least one deformable protrusion per pair of adjacent terminal rails ends, wherein a single protrusion is located on a side surface on one of said rail ends, said at least one protrusion is curved to facilitate the passage of fasteners into and out from between adjacent rails.

6. The fastener dispenser of claim 3 wherein said housing further comprises a belt clip so that said dispenser may be removably secured to a user.

7. The fastener dispenser of claim 3 further comprising a cover that can be selectively attached to said top portion of the housing and a front panel that may be selectively attached to said housing to cover said open sides and open front.

* * * * *